US011174639B2

(12) United States Patent
Thompson

(10) Patent No.: US 11,174,639 B2
(45) Date of Patent: Nov. 16, 2021

(54) ANCHOR BLOCK METHOD FOR REANCHORING LIVE TENDONS

(71) Applicant: Post Tensioning Solutions LLC, Auburn, WA (US)

(72) Inventor: Rick A. Thompson, Kent, WA (US)

(73) Assignee: POST TENSIONING SOLUTIONS LLC, Auburn, WA (US)

( * ) Notice: Subject to any disclaimer, the term of this patent is extended or adjusted under 35 U.S.C. 154(b) by 0 days.

(21) Appl. No.: 16/800,511

(22) Filed: Feb. 25, 2020

(65) Prior Publication Data

US 2020/0277788 A1 Sep. 3, 2020

Related U.S. Application Data

(60) Provisional application No. 62/811,686, filed on Feb. 28, 2019.

(51) Int. Cl.

| | |
|---|---|
| ***E04C 5/12*** | (2006.01) |
| ***E04G 17/065*** | (2006.01) |
| ***E04H 12/16*** | (2006.01) |
| *E04G 21/12* | (2006.01) |

(52) U.S. Cl.

CPC ..... *E04C 5/12* (2013.01); *E04G 17/065* (2013.01); *E04H 12/16* (2013.01); *E04G 21/12* (2013.01)

(58) Field of Classification Search

CPC ..... E04G 21/12; E04G 21/122; E04G 21/14; E04G 17/065; E04H 12/16; E04C 5/12

USPC .... 52/223.14, 223.13, 514.5, 742.16, 745.21

See application file for complete search history.

(56) References Cited

U.S. PATENT DOCUMENTS

| | | | | |
|---|---|---|---|---|
| 4,448,002 | A * | 5/1984 | Rehm | B01J 8/1818 52/223.13 |
| 4,604,003 | A * | 8/1986 | Francoeur | E02D 5/523 29/452 |
| 4,671,034 | A * | 6/1987 | Rehm | E04C 5/12 52/223.13 |
| 6,318,038 | B1 * | 11/2001 | Park | E04G 21/121 264/40.1 |
| 6,571,518 | B1 * | 6/2003 | Barley | E04C 5/127 52/223.13 |
| 6,584,738 | B1 * | 7/2003 | Andra | E04G 21/121 52/223.13 |
| 7,441,380 | B2 * | 10/2008 | Andra | E04C 5/07 14/21 |
| 7,658,041 | B2 * | 2/2010 | Andra | E04G 23/0218 52/223.14 |
| 9,068,365 | B2 * | 6/2015 | Berset | E04G 23/0218 |
| 2006/0201083 | A1 * | 9/2006 | Hayes | E04C 5/12 52/223.13 |
| 2011/0072745 | A1 * | 3/2011 | Pantelides | E01D 19/16 52/223.13 |
| 2016/0340919 | A1 * | 11/2016 | Carr | E04G 21/12 |
| 2017/0204607 | A1 * | 7/2017 | Schmidt | E04C 5/122 |
| 2017/0343078 | A1 * | 11/2017 | Manabe | D07B 1/18 |

* cited by examiner

*Primary Examiner* — Paola Agudelo

(74) *Attorney, Agent, or Firm* — Richard A. Fagin

(57) ABSTRACT

A method for retaining tension in a stressed tendon cast in a reinforced concrete structure includes removing concrete from the structure to expose the tendon, attaching a re-anchoring clamp to the exposed tendon, the re-anchoring clamp comprising two partial sections assembled to enclose the tendon, pouring grout around the re-anchoring clamp and allowing the grout to substantially cure.

5 Claims, 1 Drawing Sheet

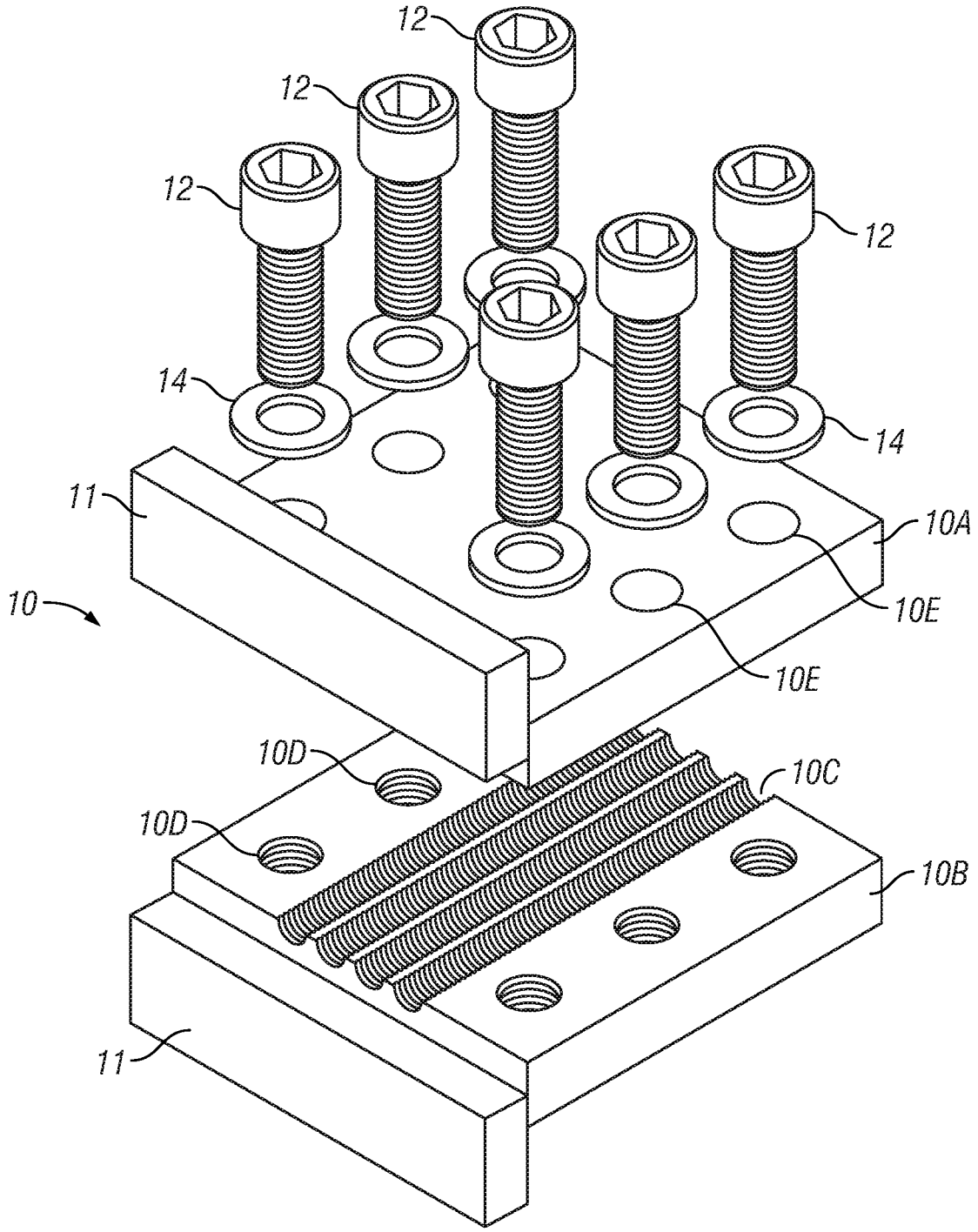
12
12
12
12
14
14
11
10A
10
10E
10E
10D
10C
10D
10B
11

ANCHOR BLOCK METHOD FOR REANCHORING LIVE TENDONS

CROSS REFERENCE TO RELATED APPLICATIONS

Priority is claimed from U.S. Provisional Application No. 62/811,686 filed on Feb. 28, 2019. The foregoing application is incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of post tension concrete reinforcing methods and apparatus. More specifically, the disclosure relates to methods and apparatus for affixing anchors to existing tendons in a concrete structure.

Concrete structures having post tension reinforcement devices, i.e., anchored tendons held in tension, may require rework, for example, to insert an opening in the existing concrete structure. In preparation for such rework, it is necessary to re-anchor the existing tendons, that is, to affix new anchors on selected tendons at the edge of the new opening. Using rework methods known in the art, it is required to break and remove concrete proximate the location of the new anchor(s), cut the tendon(s), affix the anchor(s) to the tendons, and pour concrete to form the edge of the opening. The poured concrete is allowed to cure before the cut tendon(s) are tensioned. During the above procedure, from the time the tendon(s) are cut until the time the cut tendon(s) are tensioned again, the concrete structure must be shored, that is, some form of support must be provided to avoid failure of the concrete structure as a result of relaxing the support provided by the tendon(s) that have been cut.

SUMMARY

A method according to one aspect of the present disclosure for retaining tension in a stressed tendon cast in a reinforced concrete structure includes removing concrete from the structure to expose the tendon and attaching a re-anchoring clamp to the exposed tendon. The re-anchoring clamp comprises two partial sections assembled to enclose the tendon. The method further includes cutting the tendon, pouring grout around the re-anchoring clamp and allowing the grout to substantially cure.

Some embodiments further comprise removing a part of the concrete structure comprising a cut part of the tendon apart from the anchor.

In some embodiments, the removed part forms an opening in the concrete structure.

BRIEF DESCRIPTION OF THE DRAWINGS

FIG. 1 shows an example embodiment of a tendon clamp to maintain tension on a tendon.

DETAILED DESCRIPTION

In a method for reworking a reinforced concrete structure according to the present disclosure, the following actions may be performed. First, based on where part of the concrete structure is to be reworked, such as to make an opening, the tendon(s) that will require re-anchoring should be located within the concrete structure with respect to position and depth. The location of such tendons may be used to determine the best places to chip out the concrete in the reinforced concrete structure to expose the tendons.

Once the places to chip out the concrete are determined, at each such location, a hole large enough to allow a re-anchoring block to be installed around the stressed or "live" tendons may be created by chipping out the concrete of the reinforced concrete structure.

The re-anchoring block is installed around the live tendon(s) to be re-anchored. Installation may comprise affixing one part of the re-anchoring block on each side of the tendon(s), installing through bolts and tightening the through bolts. The tendon(s) may then be cut. The re-anchoring clamp will transfer tension in the tendon(s) to the face of the opening in the concrete structure. Grout may then be poured into the hole and the re-anchoring block clamped around the tendon(s).

The grout may be allowed to cure substantially to full compressive strength after pouring. The same procedure may be performed at all tendon locations to be re-anchored prior to cutting any such tendons. It is important to ensure that the curing of the grout is substantially complete while the tendons are still live, that is, prior to cutting. This makes it possible to cut only one tendon or one group of tendons before repeating the procedure on subsequent tendons or groups of tendons. This enables keeping as many tendons as possible under load so as to avoid the need to re-shore the concrete structure for de-tensioning and re-stressing. Once the grout is substantially fully cured, the tendon(s) may be cut.

The foregoing procedure may be repeated for each tendon and/or group of tendons in any area to be reworked. Once all tendons have been cut, it is then possible to cut the opening or the concrete section to be removed without the need to perform any action on tendons present in such section because any such tendons have been decoupled from the reinforcing system.

A re-anchoring block according to one embodiment may be in the form of a two-part block-shaped clamp that can be placed around one or more live tendons. This makes possible for the live tendons to be cut after pouring the grout.

FIG. 1 shows an example embodiment of a re-anchoring clamp. The re-anchoring clamp 10 may comprise a first clamp section 10A and a second clamp section 10B. Each clamp section 10A, 10B may comprise grooves 10C each shaped to receive a tendon and retain the tendon without substantial deformation when the first clamp section 10A and the second clamp section 10B are coupled together. Such coupling may be performed by tightening fasteners 12, for example cap screws such as socket head cap screws. In one embodiment the fasteners may pass freely through suitably sized holes 10E in the first clamp section 10A. In the present example embodiment, holes 10D in the second clamp section 10B may be threaded to receive the fasteners 12. In other embodiments, the holes 10D may be similar to those in the first clamp section 10A so that locking the fasteners 12 may be performed by nuts (not shown). Flat or lock washers 14 may be used in some embodiments.

In the present embodiment, the re-anchoring clamp 10 may comprise a thrust face 11 on each of the first clamp section 10A and the second clamp section 10B so that tension from the tendon may be transferred to the concrete structure at the edge of the opening prior to cutting the live tendon(s).

Using a re-anchoring clamp according to the present disclosure, it may be possible to avoid re-shoring that is often a time consuming and expensive part of cutting out and removing post-tensioned concrete slabs.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for maintaining tension on a stressed tendon cast in a reinforced concrete structure, comprising:

removing concrete from the structure to expose a first tendon, the first tendon being under stress to support the structure;

attaching a re-anchoring clamp to the exposed tendon, the re-anchoring clamp comprising two partial sections assembled to enclose the tendon;

pouring grout around the re-anchoring clamp;

allowing the grout to substantially cure; and then cutting the first tendon.

2. The method of claim 1 further comprising making an opening in the concrete structure in an area of the concrete structure comprising a cut part of the first tendon.

3. The method of claim 2 further comprising repeating the removing concrete to expose at least a second tendon under stress to support the structure, attaching a re-anchoring clamp to the at least one additional tendon, pouring grout, allowing the grout to substantially cure and then cutting the at least a second tendon.

4. The method of claim 3 further comprising making an opening in the concrete structure comprising a cut part of the first tendon and the at least a second tendon.

5. The method of claim 1 further comprising exposing at least a second tendon by the removing concrete, attaching the re-anchoring clamp to the at least a second tendon, and after allowing the grout to cure, cutting the at least a second tendon.

* * * * *